US005675839A

United States Patent [19]

Gordon et al.

[11] Patent Number: 5,675,839

[45] Date of Patent: Oct. 14, 1997

[54] PUSH HAND COVERING WITH REMOVAL ASSIST

[75] Inventors: Paula Gordon, The Woodlands, Tex.; Gary Moss, Oak Park, Ill.

[73] Assignee: Wells Lamont Technologies, Inc., Chicago, Ill.

[21] Appl. No.: 595,058

[22] Filed: Feb. 1, 1996

[51] Int. Cl.[6] ..... A41D 19/00

[52] U.S. Cl. ..... 2/159; 2/163

[58] Field of Search ..... 2/20, 161.6, 163, 2/160, 159, 161.1, 161.7; 223/111

[56] References Cited

U.S. PATENT DOCUMENTS

| | | | |
|---|---|---|---|
| Re. 34,573 | 4/1994 | Calvert | 2/2 |
| 61,428 | 1/1867 | Hindman . | |
| 801,623 | 10/1905 | Weakley | 2/163 |
| 975,734 | 11/1910 | Tebeau | 2/20 |
| 2,325,482 | 7/1943 | Curran | 2/159 |
| 2,379,430 | 7/1945 | Frost | 2/159 |
| 2,617,109 | 11/1952 | Slimovitz | 2/163 |
| 2,782,422 | 2/1957 | Bencriscutto | 2/161 |
| 3,875,591 | 4/1975 | Cantales | 2/161 A |
| 3,930,271 | 1/1976 | Kahng | 2/161 A |
| 4,368,883 | 1/1983 | Tiktin | 2/163 |
| 4,519,097 | 5/1985 | Chappell, Jr. et al. | 2/16 |
| 4,701,963 | 10/1987 | Overton | 2/161.1 |
| 4,785,477 | 11/1988 | Marzo | 2/163 |
| 4,796,306 | 1/1989 | Mitchell | 2/163 |
| 4,876,747 | 10/1989 | Coffey et al. | 2/168 |
| 5,004,227 | 4/1991 | Hoffman | 2/159 |
| 5,018,221 | 5/1991 | Romandetto | 2/161.1 |
| 5,022,094 | 6/1991 | Hames et al. | 2/163 |
| 5,025,502 | 6/1991 | Raymond et al. | 2/159 |
| 5,224,220 | 7/1993 | Andriola | 2/160 |
| 5,257,418 | 11/1993 | Jaskiewicz | 2/20 |
| 5,276,922 | 1/1994 | Floyd, Jr. | 2/160 |
| 5,373,585 | 12/1994 | Wiggins | 2/163 |

*Primary Examiner*—Amy B. Vanatta
*Attorney, Agent, or Firm*—Keck, Mahin & Cate

[57] ABSTRACT

A hand covering for protecting a wheelchair user's hand while engaging a wheel of the chair to rotate or stop the rotation of the wheel. The hand covering is provided with tabs, on the back of the finger portions, under which fingers of the user's other hand may be placed to exert a force to remove the hand covering from the user's hand.

20 Claims, 2 Drawing Sheets

PUSH HAND COVERING WITH REMOVAL ASSIST

BACKGROUND OF THE INVENTION

1. Field of the Invention

This invention relates to a hand covering particularly designed to protect a wheelchair user's hands when turning the wheels of a wheelchair. More particularly, it relates to providing a glove which has a cushioned palm and is free of seams in the crotch area between the thumb and the outside lateral edge of the index finger to a point near the finger tip, which could interfere with the grasping of a wheelchair wheel. It also relates to a hand covering which is provided with removal tabs to assist a user in removing the hand covering from a hand. It further relates to a hand covering which is provided with an easily engaged and disengaged strap for encircling the wrist of a user.

2. Description of Related Art Including Information Disclosed Under 37 C.F.R. §§ 1.97 and 1.98

Cushioned hand coverings have been provided in the past for various purposes. However, applicant is unaware of any which have been specifically designed as hereinafter described for use by a wheelchair user when turning the wheels of the wheelchair. Further, the use of one or more tabs on the back of the finger-encircling portion of a hand covering to assist in removal of the hand covering from the hand has not been revealed in the prior art. Prior hand covering having a construction designed to assist in their removal are disclosed in the following patents:

| U.S. Pat. No. | Inventor |
|---|---|
| 2,325,482 | Curran |
| 4,876,747 | Coffey et al. |
| 5,025,502 | Raymond et al. |
| 5,224,220 | Andriola |

The Curran patent shows a glove with a pull member attache to the cuff for pulling the glove onto a hand. The Coffey et al patent reveals an elastomeric glove with a raised loop attached to the wrist portion which may be engaged by a hook to remove the glove from the user's hand. The Raymond et al patent reveals a glove which is provided with a mouthpiece such that air may be forced into the space between the glove and the skin to assist in removing the glove. The Andriola patent reveals a glove having five pull-strings attached to the ends of the glove fingers with the opposite end of the pull-strings being attached to a tab which may be pulled on to remove the glove. The tab is also provided with engagement means for affixing it to the backhand portion of the glove.

SUMMARY OF THE INVENTION

It is an object of this invention to provide a wheelchair push hand covering which protects the portion of the user's hand which engages the wheel of a wheelchair to propel or stop the wheelchair. It is another object of the invention to provide a hand covering which is constructed so as to provide for easy removal of the hand covering from the hand. It is still another object of the invention to provide a wheelchair push glove which is constructed such that the crotch area between the thumb and the index finger provides extra padding for protection and a seam free design when gripping the wheel of the wheelchair.

In accordance with this invention, a wheelchair push glove is provided which is readily manufactured and provides protection to the user's hand, particularly in the palm area, is provided with removal assist components, and is readily secured about the user's wrist with a quickly engaging and disengaging strap. The push hand covering in accordance with this invention is provided with gel or foam padding in the palm area. The glove is further formed with finger-covering portions. In accordance with the preferred form of this invention, the palm side of the glove is formed of a wear-resistant and grip-enhancing material, while the back hand portion of the glove and finger encircling portions, other than the index finger, are formed of a more supple and stretchable material. The index finger is formed entirely of the wear-resistant material and is constructed such that the seams to form it are adjacent the middle finger, with no seams being formed in the area facing the thumb.

To assist in the removal of the glove, components in the form of tabs or loops are provided on the back of one or more of the finger-encircling portions. The tabs or loops form openings into which a finger of the other hand may be inserted so as to apply a force in the direction of the fingertips to remove the hand covering from the hand. The back hand portion of the glove adjacent the wrist and a strap are provided with hook-and-loop type fastening materials which may be readily engaged and disengaged to secure and release the hand covering from the hand.

DETAILED DESCRIPTION OF THE PREFERRED EMBODIMENTS

Figure 1:
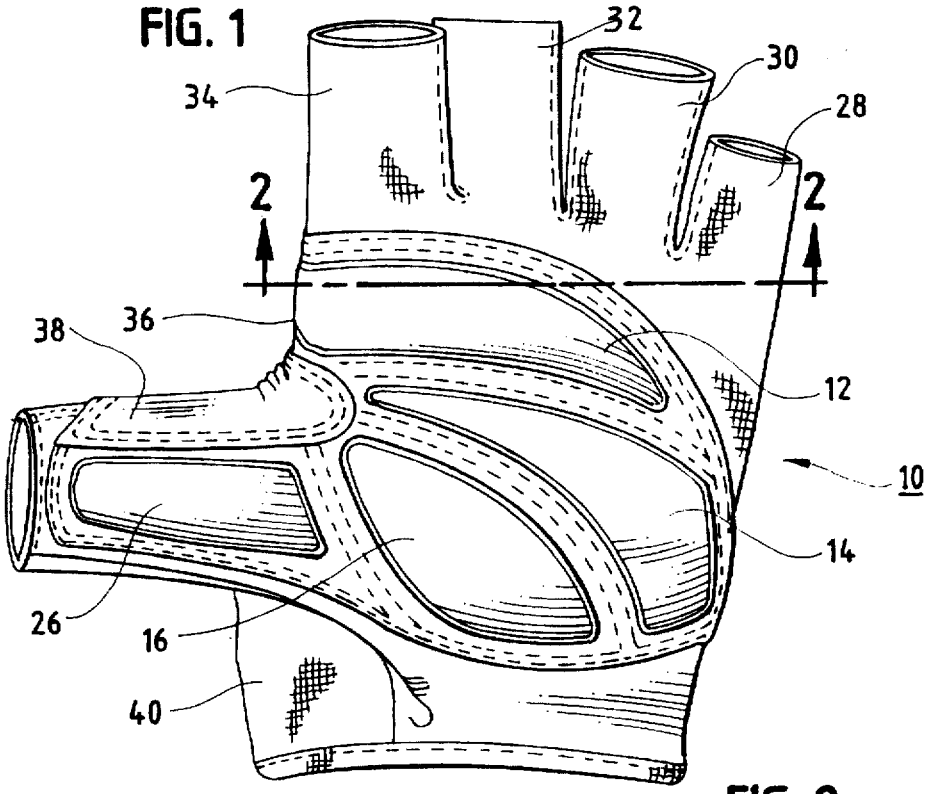
FIG. 1 is an elevation view of the palm face of a push hand covering in accordance with this invention.
Figure 2:
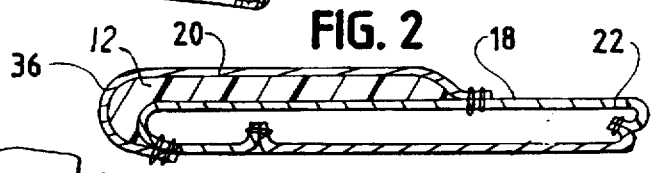
FIG. 2 is a cross-sectional view of the hand covering shown in FIG. 1, taken along the line 2—2 in FIG. 1.

Referring to FIG. 1, a wheelchair push hand covering in accordance with this invention, in the form of a half-finger glove, will be described. The palm face of glove 10 is provided with protective pads formed of gel or foam to provide cushioning to the users hand. The preferred embodiment shown is provided with three gel or foam pads, 12, 14 and 16. As shown in FIG. 2, the gel pads such as 12 are sandwiched between an inner layer 18 and an outer 20. In a preferred construction, the protective pads are cut from a sheet of gel or foam rubber. The inner layer 18 includes a wear-resistant and gripping-enhancing material 22 and a lining 24. A preferred material for the wear-resistant and grip-enhancing material 22 is leather, although other materials such as vinyl or neoprene may also be used. A suitable material for the lining 24 is a polyester material. The outer layer 20 is formed of a material which provides both a wear-resistance and a grip-enhancing surface, such as leather. Other materials such as vinyl or neprene may also be used.

Similar to the gel or foam pads 12, 14 and 16 provided on the palm portion of the hand covering, a gel pad 26 is also provided on the inside surface of the thumb. As shown in FIG. 1, finger-encircling portions 28, 30, 32 and 34 of the hand covering extend to the first knuckle.

Figure 3:
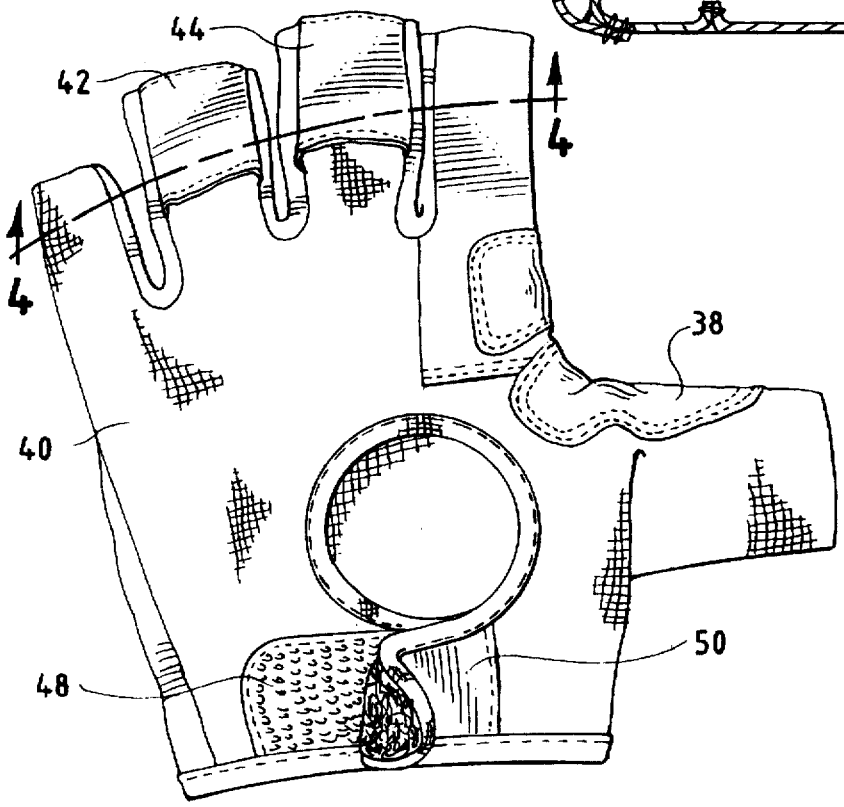
FIG. 3 is an elevation view of the backhand portion of the hand covering of FIG. 1.
Figure 5:
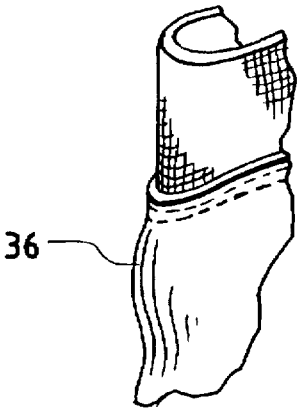
FIG. 5 is a perspective view of the outside edge of the index finger, taken along the line 5—5 in FIG. 1.

As shown in FIGS. 1, 2 and 3, the gel or foam pad 12 and the material covering it extend partially around the index finger as shown at 36 in FIGS. 2 and 3. Further, a reinforcing piece of wear-resistance and friction-engaging material 38, such as leather is provided in the crotch area between the thumb and index finger, and partially encircles the thumb. The reinforcing piece 38 contacts the wheelchair wheel, which is normally placed between the thumb and the index finger of the wheelchair users hand. It will be observed by making reference to FIG. 5, that the outside surface of the index finger is formed without a seam running along the outside edge of the finger. If such a seam were present, it would be engaged by a wheel chair wheel at an angle, which would impair the ability of the user to grip the wheel properly due to discomfort from the presence of a seam in a vulneralble area causing pressure or skin breakdown.

Referring again to FIG. 3, the back hand portion of the hand covering is formed of a soft material 40 which is stretchable so as to snugly hold the hand covering over the hand. In a preferred embodiment, the soft material 40 is cotton terry cloth, although other materials with sufficient stretch such as spandex incorporated in a fabric may be used. As shown in FIG. 3, the back-hand portion of the index finger encircling portion 34 is formed of the same material as the palm-side portion of the hand covering.

Figure 4:
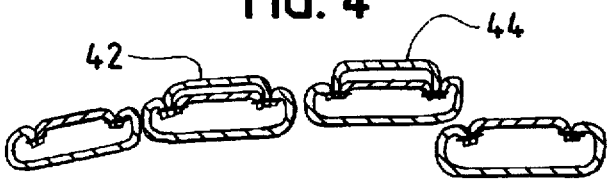
FIG. 4 is a cross-sectional view of the hand covering shown in FIG. 3, taken along the line 4—4 in FIG. 3.

Referring particularly to FIGS. 3 and 4, components in the form of tabs or loops of material 40 and 42 are provided on the back side of the ring and middle ingers adjacent their distal ends. The tabs could, if desired, be placed on any or all digits of the hand covering. These tabs are secured to the fingers of the hand covering when forming the seams between the materials forming the palm portion and the back-hand portion of the fingers. In the preferred embodiment, the tabs 40 and 42 are formed of the same material as that used to form the palm portion of the glove, although other materials could be used.

Figure 6:
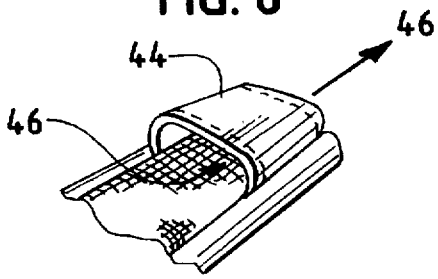
FIG. 6 is a perspective view of the removal tab provided in accordance with this invention.

Referring to FIG. 6, arrows 46 indicate the direction in which one inserts the fingers of the hand opposite that upon which the hand covering is worn to exert a force in the direction toward the tip of the fingers to remove the hand covering from the hand.

To secure the hand covering about the user's wrist, one portion 48 of a hook-and-loop material is provided on the back-hand portion of the hand covering, while the inside surface of a tab 50 is provided with a complementary portion of the hook-and-loop material. To secure the hand covering on a hand, the strap 48 is pulled tightly about the wrist and the hook-and-loop materials engaged.

In the preferred embodiment, the hand covering as shown is assembled by stitching the various portions to each other. However, other methods could be used to secure the parts to each other, such as by using a bonding agent.

Figure 7:
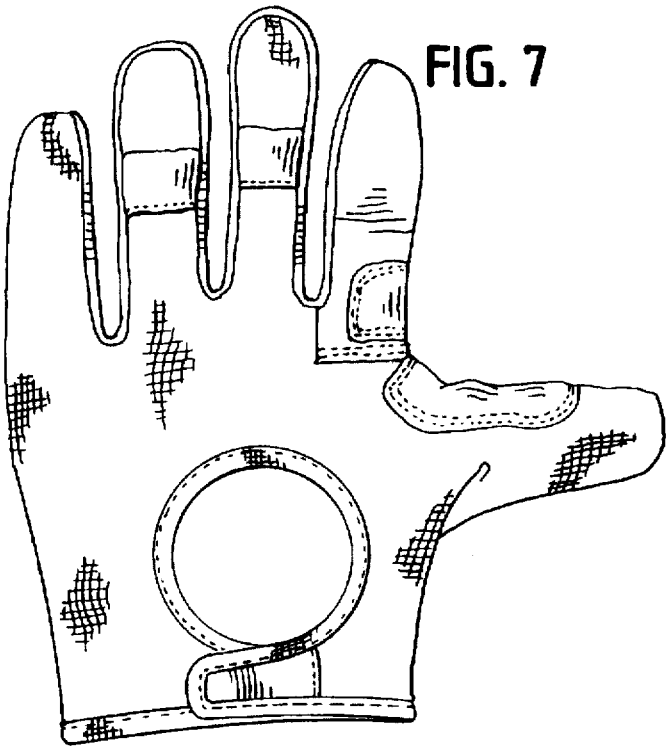
FIG. 7 is an elevation view of the palm face of a second embodiment of the hand covering in accordance with this invention.

While FIGS. 1–6 illustrate a half-finger embodiment of the wheelchair push glove, it is also envisioned that the glove could be provided in a full-finger embodiment, as shown in FIG. 7. The construction of the hand covering of FIG. 7 is essentially the same as that shown in FIGS. 1–6 but for the full covering of the fingers. The tabs 40 and 42 are provided on the back side of the ring and middle fingers to assist in removal as described with respect to the first embodiment.

While one embodiment of the wheelchair push glove hand covering of this invention has been shown, it should be apparent to those skilled in the art that what are described are considered to be the preferred embodiments of the wheelchair push hand covering. In accordance with the patent statutes, changes may be made in the wheelchair push hand coverings in accordance with this invention without actually departing from the spirit and scope of this invention. The following claims are intended to cover all such changes and modifications which fall in the true spirit and scope of this invention.

What is claimed:

1. A hand covering, comprising:

a hand encircling portion;

finger encircling portions, each one of said finger encircling portions having a longitudinal axis; and at least one finger-receiving loop having a portion secured in fixed relation to the back of only one of the finger encircling portions, said at least one finger-receiving loop defining an opening having a center axis substantially parallel to the longitudinal axis of said only one of the finger encircling portions, whereby with the hand covering worn on a first hand, a finger of the opposite hand may be inserted in the loop and a force applied by the opposite hand to remove the hand covering from the first hand.

2. The hand covering of claim 1, having four finger encircling and one thumb encircling portions.

3. The hand covering of claim 1, wherein an index finger encircling portion is made of a material with a seam only being formed on the side of the finger next to the middle finger.

4. The hand covering of claim 1, wherein a resilient padding is provided on a palm surface of said hand encircling portion of said hand covering.

5. The hand covering of claim 1, wherein said loop is formed of a narrow strip of material secured to the back of the finger encircling portion of the glove.

6. The hand covering of claim 1 wherein said loop is located adjacent the joint of the finger closest to the knuckle.

7. The hand covering of claim 1, wherein said loops are provided on the back of the middle and ring fingers.

8. The hand covering of claim 1, wherein the finger encircling portions extend only to the joint adjacent the knuckle of the finger.

9. The hand covering of claim 1, wherein the finger encircling portions cover the entire fingers.

10. A hand covering, comprising:

a palm and back hand encircling portion;

at least one finger encircling portion, each one of said finger encircling portions having a longitudinal axis; and at least one finger-receiving loop having a portion secured in fixed relation to the back of only one of said at least one finger encircling portion, said at least one finger-receiving loop defining an opening having a center axis substantially parallel to the longitudinal axis of said only one of the finger encircling portions, whereby with the hand covering worn on a first hand, a finger of the opposite hand may be inserted in said loop and a force applied toward the tips of the fingers of the first hand by the opposite hand to remove the hand coveting from the first hand.

11. The hand covering of claim 10, having four finger encircling and one thumb encircling portions.

12. The hand covering of claim 10, wherein an index finger encircling portion is made of a material with a seam only being formed on the side of the finger next to the middle finger.

13. The hand covering of claim 10, wherein a resilient padding is provided on a palm surface of said palm and back hand encircling portion of said hand covering.

14. The hand covering of claim 10, wherein said loop is formed of a narrow strip of material secured to the back of the finger encircling portion of the glove.

15. The hand covering of claim 10 wherein said loop is located adjacent the joint of the finger closest to the knuckle.

16. The hand covering of claim 10, wherein said loops are provided on the back of the middle and ring fingers.

17. The hand covering of claim 10, wherein the finger encircling portions extend only to the joint adjacent the knuckle of the finger.

18. The hand covering of claim 10, wherein the finger encircling portions cover the entire fingers.

19. A glove, comprising:

a palm encircling portion:

at least one finger encircling portion, each one of said finger encircling portions having a longitudinal axis; and at least one finger-receiving loop having a portion secured in fixed relation to the back of only one of said at least one finger encircling portion, said at least one finger-receiving loop defining an opening having a center axis substantially parallel to the longitudinal axis of said only one of the finger encircling portions, whereby with the glove worn on a first hand, a finger of the opposite hand may be inserted in the loop and a force applied by the opposite hand toward the tips of the fingers of the first hand to remove the glove from the first hand.

20. A hand covering, comprising:

a hand encircling portion having a palm surface;

finger encircling portions, including an index and middle finger encircling portion, the index finger encircling portion being formed of a material with a seam only being formed on the side of the index finger encircling portion next to the middle finger encircling portion, each one of said finger encircling portions having a longitudinal axis;

a resilient padding provided on the palm surface of said hand encircling portion of said hand covering; and at least one finger-receiving loop having a portion secured in fixed relation to the back of only one of the finger encircling portions, said at least one finger-receiving loop defining an opening having a center axis substantially parallel to the longitudinal axis of said only one of the finger encircling portions, whereby with the hand covering worn on a first hand, a finger of the opposite hand may be inserted in the loop and a force applied by the opposite hand to remove the hand covering from the first hand.

* * * * *